United States Patent [19]

Mahnke

[11] Patent Number: 5,002,030

[45] Date of Patent: Mar. 26, 1991

[54] FUEL RAIL ASSEMBLIES FOR INTERNAL COMBUSTION ENGINES

[75] Inventor: Randall M. Mahnke, Newport News, Va.

[73] Assignee: Siemens-Bendix Automotive Electronics L.P., Troy, Mich.

[21] Appl. No.: 563,738

[22] Filed: Aug. 3, 1990

Related U.S. Application Data

[63] Continuation of Ser. No. 250,544, Sep. 29, 1988, abandoned.

[51] Int. Cl.[5] ..... F02M 55/02

[52] U.S. Cl. ..... 123/469; 123/468; 123/470; 123/456; 285/281

[58] Field of Search ..... 123/468, 469, 470, 472, 123/456; 285/232, 279, 281, 921

[56] References Cited

U.S. PATENT DOCUMENTS

| | | | |
|---|---|---|---|
| 2,438,530 | 2/1948 | Woodling | 285/281 |
| 3,776,209 | 12/1973 | Wertheimer et al. . | |
| 4,286,563 | 9/1981 | Fahim et al. . | |
| 4,294,215 | 10/1981 | Hans | 123/470 |
| 4,307,693 | 12/1981 | Glöckler | 123/469 |
| 4,510,909 | 4/1985 | Elphick | 123/469 |
| 4,586,477 | 5/1986 | Field | 123/468 |
| 4,687,235 | 8/1987 | Stoll | 285/281 |
| 4,712,809 | 12/1987 | Legris | 285/281 |
| 4,778,203 | 10/1988 | Bartholomew | 285/921 |
| 4,823,754 | 4/1989 | Minamoto | 123/468 |

FOREIGN PATENT DOCUMENTS 0238156 9/1987 European Pat. Off. .

*Primary Examiner*—Carl Stuart Miller

*Attorney, Agent, or Firm*—Russel C. Wells; George L. Boller

[57] ABSTRACT

Fuel rail assemblies include a tubular fuel rail for supplying fuel to a fuel injector of an internal combustion engine. Rigid conduits are coupled to the fuel rail so as to allow relative rotational movements therebetween and thus permit, during production, the correction of any angular mismatch between the injectors and the engine with which the injectors are to be associated. A longitudinally extending, lateral ledge may be provided so as to support a clip which retains the injectors in the fuel rail assembly during production. Countercurrent flow within some embodiments of the fuel rail assemblies is provided by positioning an inner conduit within an outer conduit so as to establish therebetween a fuel flow passageway. Thus, the supply and discharge nipples for the fuel rail may be provided in close physical relationship with one another and thereby more easily facilitate their interconnection to a vehicle's fuel system during production.

7 Claims, 5 Drawing Sheets

FUEL RAIL ASSEMBLIES FOR INTERNAL COMBUSTION ENGINES

This application is a continuation of prior complete application Ser. No. 07/250,544 filed on Sept. 29, 1988, now abandoned.

FIELD OF THE INVENTION

The present invention is related to the field of internal combustion engines, and more particularly, to internal combustion engines which employ fuel injectors. In specific embodiments, the invention relates to means by which an available standby source of fuel is provided for fuel injectors of an internal combustion engine (such means usually being referred to in art parlance as a "fuel rail"). The fuel rails of this invention include especially adapted coupling assemblies so as to couple fuel supply/discharge conduits to the fuel rail to thereby allow relative rotational motion therebetween and hence facilitate assembly of the fuel rails to internal combustion engines.

BACKGROUND AND SUMMARY OF THE INVENTION

Fuel injected internal combustion engines have in recent years been employed by automotive manufacturers as a more fuel efficient alternative to conventional carbureted engines. Moreover, fuel injected internal combustion engines provide a more accurate means (as compared to carbureted engines) to control a variety of engine operating parameters via an on-board electronic control unit (ECU).

Fuel is typically supplied to the injectors by means of one or more rigid conduits (usually referred to as "fuel rails" in art parlance). The fuel rails are thus adapted to receiving the injectors at spaced-apart locations along the fuel rail so as to be in alignment with respective positions of the intake ports of an internal combustion engine. In such a manner, fuel from the vehicle's fuel system may be supplied to the individual injectors via the fuel rail.

During production of fuel injected internal combustion engines, the fuel rail will usually have the injectors dependently attached thereto in some fashion (usually via a clip). This fuel rail/injector subassembly may then be mated with an engine block during assembly line production so that the injectors are positioned within respective intake ports of the engine.

Mating of the fuel rail/injector subassembly usually presents little problems during production of in-line configured engines (e.g., a four cylinder engine in which all of the cylinders are oriented "in-line" relative to the engine block). However, potential problems relating to angular mismatch as between the injectors of the fuel rail/injector subassembly and the intake ports of the engine block in which the injectors are to be seated may occur with V-configured engines (e.g., six or eight cylinder engines in which one bank of cylinders is situated laterally of the other cylinder bank, with the respective cylinder banks being oriented in a V-shape as viewed from the end of the engine block). For these reasons, it would be very desirable if the fuel rail included the means by which any angular mismatch between the fuel rail/injector subassembly and the intake ports of the engine block could be corrected on line during manufacturing.

As indicated briefly above, fuel rails must ultimately be connected to the vehicle's fuel system which usually entails connecting an inlet and an outlet of the fuel rail to "quick connectors" of conduits (typically flexible conduits) associated with the supply and return sides, respectively, of the vehicle's fuel system. Hence, during production, it would also be very desirable if the inlet and outlet of the fuel rail were each closely located relative to one another so that the interconnection with the vehicle's fuel system may be more efficiently accomplished by an assembly line worker.

It is towards achieving such desired attributes of automotiVe fuel rails that the present invention is specifically directed.

According to one aspect of the present invention, a novel fuel rail is provided which includes the means by which angular mismatch between the fuel rail/injector subassembly is capable of being corrected on line during manufacture of the engine. At least one end of the fuel rail defines a recess in which an end of a rigid fuel conduit is accepted. The fuel conduit is itself provided with an annular flange which is retained in the recess of the fuel rail by means of a fixed-position, arcuately shaped retainer flange. The end of the retainer flange thus bears against the annular flange of the fuel conduit so as to retain the latter within the recess of the fuel rail, while yet also allowing relative rotational movements between the fuel rail and the fuel conduit. This relative rotational movement may then be used during manufacture so as to correct any angular mismatch which may be present between the fuel rail/injector subassembly and the engine block.

Inlet and outlet nipples may also be provided closely adjacent one another according to another aspect of this invention. That is, the present invention also contemplates a fuel rail comprised of a pair of substantially concentrically disposed conduits which define therebetween an annular space through which fuel may flow. Means may be provided at a terminal end of the inner conduit so as to positionally concentrically retain it within the outer conduit, and to establish fluid communication between the inner conduit and the annular passageway. In such a manner, the fuel rails of this invention may establish countercurrent flow of fuel therewithin.

These, as well as other aspects and advantages of this invention will become more clear after careful consideration is given to the detailed description of the preferred exemplary embodiments which follow.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
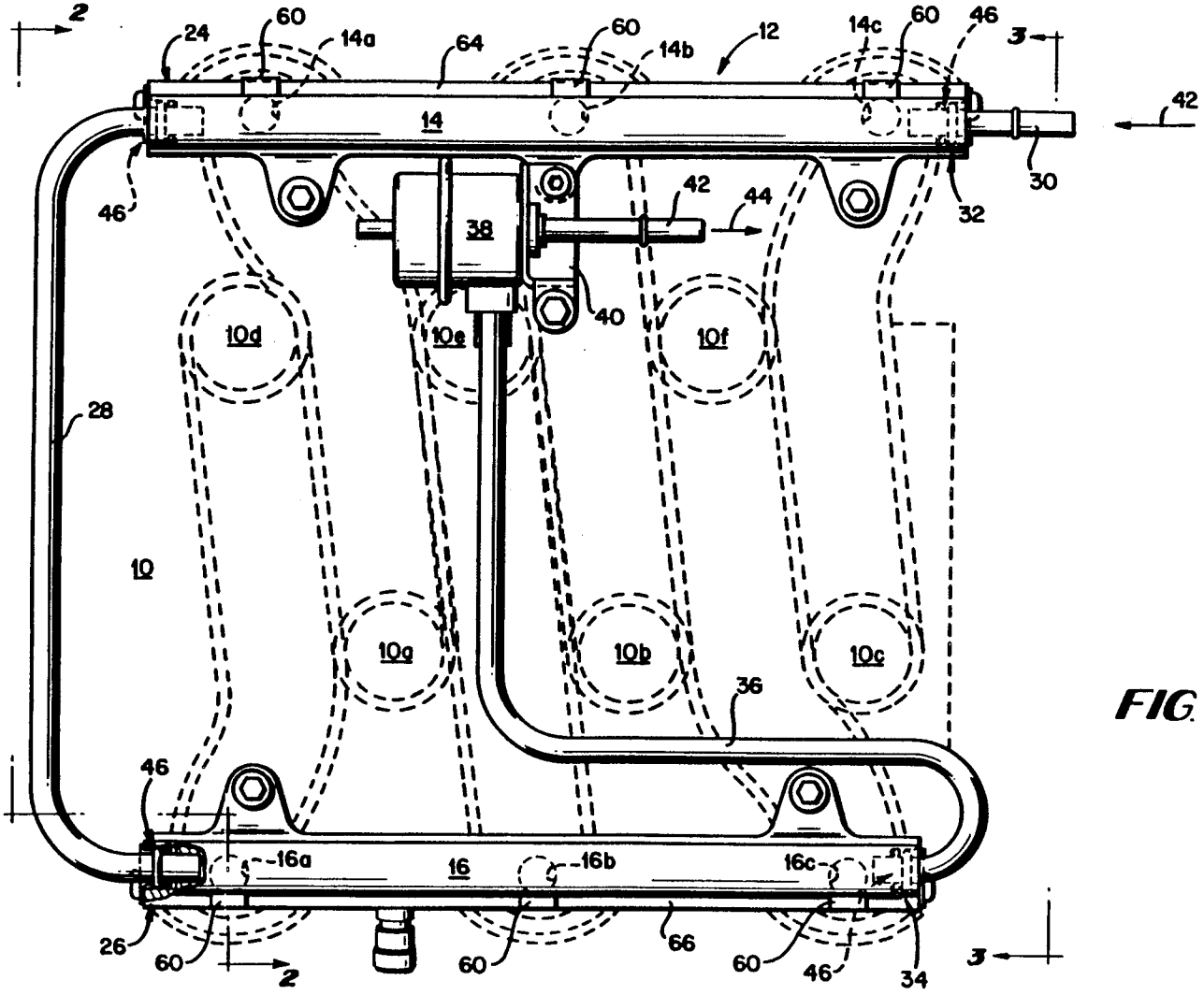
FIG. 1 is a top plan view of one specific exemplary embodiment of a fuel rail assembly according to the present invention.
Figure 2:
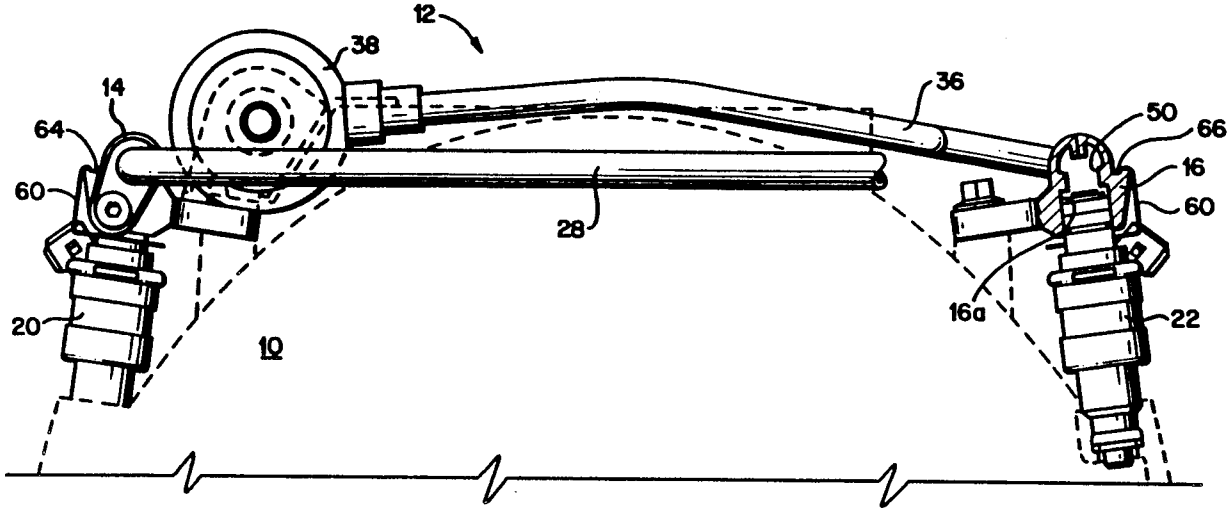
FIG. 2 is an end elevational view of the assembly shown in FIG. 1 as taken along line 2—2 therein.
Figure 3:
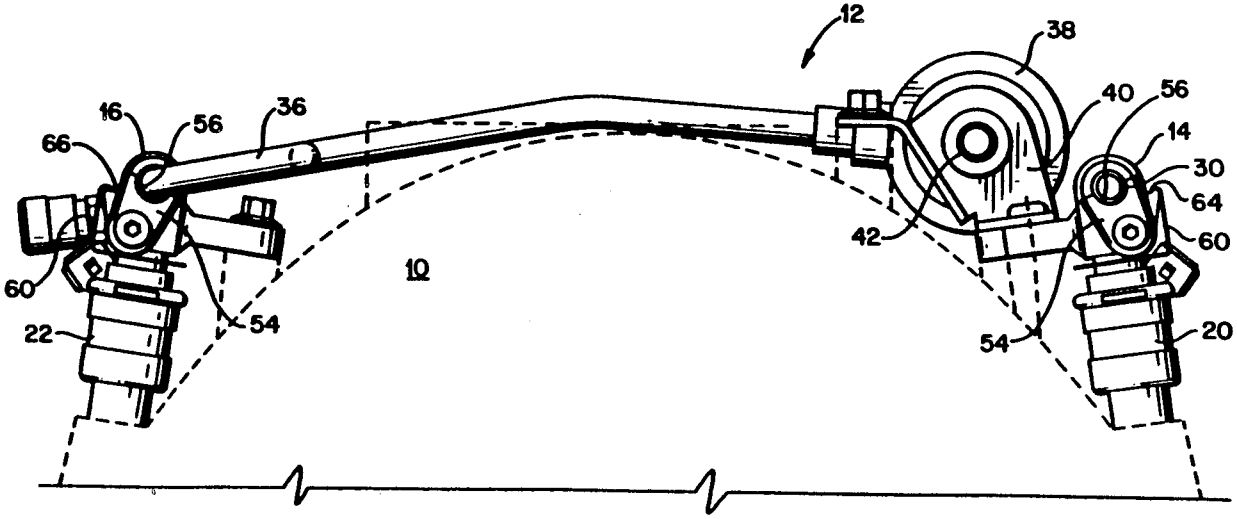
FIG. 3 is another end elevational view of the assembly shown in FIG. 1 as taken along line 3—3 therein.

An exemplary internal combustion engine 10 which employs one preferred embodiment of the fuel rail assembly 12 according to the present invention is shown in accompanying FIGS. 1-3. The assembly 12 just happens to be associated with a V-6 configured engine 12, but other engine configurations (including in-line configured engines) could employ the beneficial attributes of this invention to be discussed in greater detail below.

Since the assembly 12 is depicted in accompanying FIGS. 1-3 as eing employed with a V-configured engine, a pair of rigid elongate tubular fuel rails 14 and 16 are provided in substantially parallel disposition relative to one another. That is, fuel rail 14 supplies fuel to injector ports 14*a*–14*c* in which an inlet end of fuel injectors 20 (see FIGS. 2 and 3) is received so as to service one bank of combustion chambers 10*a*–10*c* of engine 10, respectively. On the other hand, fuel rail 16 supplies fuel to injector ports 16*a*–16*c* in which an inlet end of fuel injectors 22 (see FIGS. 2 and 3) is received so as to service the other bank of combustion chambers 10*d*–10*f* of engine 10, respectively.

Fuel rails 14 and 16 are fluid-connected to one another at their respective ends 24 and 26 via a rigid conduit 28. In the embodiment shown, conduit 28 is in the form of a shallow U-shaped element so as to maintain the substantially parallel relationship between the rails 14 and 16. However, other configurations of conduit 28 are possible in dependence upon the particular fuel path needed for a particular engine design. A supply nipple 30 is coupled to the end 32 of fuel rail 14 (which is opposite to end 24) and is adapted to being interconnected to the supply side of a vehicle's fuel system via flexible or rigid conduit (not shown). The end 34 of fuel rail 16 is fluid-connected via rigid conduit 36 to a fuel regulator 38, which itself is preferably rigidly coupled to rail 14 via mounting bracket 40.

As will be appreciated, fuel is supplied coaxially to rail 14 via supply nipple 30 (i.e., in the direction of arrow 42 in FIG. 1), flows through rail 14 so as to supply fuel to the injectors 20 associated therewith. Fuel will also flow from rail 14 to rail 16 via conduit 28 where it is supplied to the injectors 22 via ports 16*a*–16*c*. The fluid circuit is then completed by means of the fuel flowing from rail 16, consecutively through conduit 36 and regulator 38, and then being discharged from regulator 38 to the return side of a vehicle's fuel system (not shown) via discharge nipple 42 in the direction of arrow 44.

Important to the present invention is the coupling means 46 employed to couple the ends of conduit 28 to the respective ends 24 and 26 of fuel rails 14 and 16, in addition to coupling an end of conduit 36 to end 34 of fuel rail 16 and/or supply nipple 30 to end 32 of fuel rail 14. The preferred coupling means 46 employed in the present invention is shown in greater detail in accompanying FIG. 4.

Figure 4:
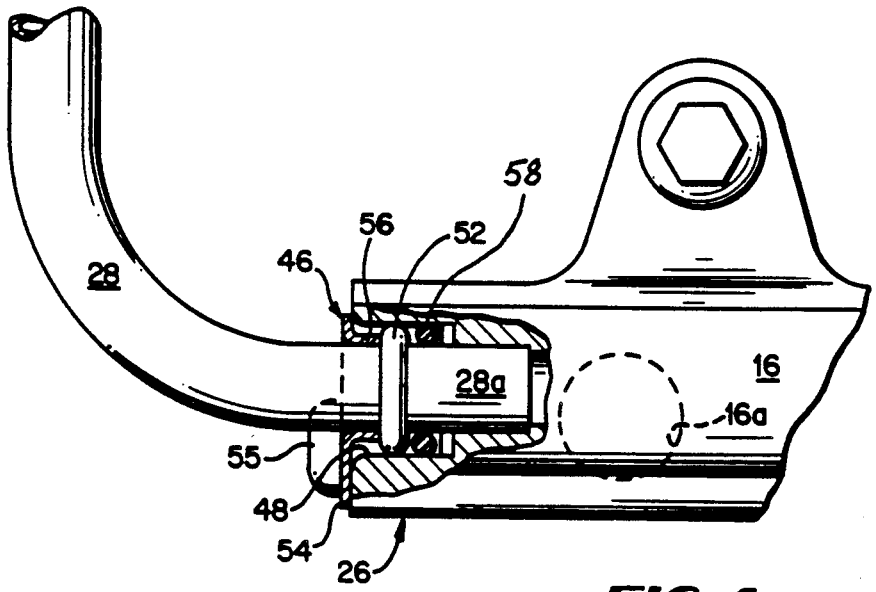
FIG. 4 is an enlarged cross-sectional view showing the means employed to couple fuel conduits to the fuel rails of the assembly shown in FIG. 1.

As is seen in FIG. 4, an axial recess 48 is formed in end 26 of fuel rail 16 so as to receive a terminal end 28*a* of conduit 28. In such a manner, fuel will flow from the end 28*a* of conduit 28 in substantially coaxial relationship to interior chamber 50 of fuel rail 16 (see FIG. 2). End 28*a* of conduit 28 includes an integral annular flange 52 which is maintained within recess 48 by means of a retainer 54. A suitable bolt 55 rigidly connects retainer 54 to end 26 of fuel rail 14. Retainer 54 also includes an arcuately shaped flange 56 so as to provide a saddle support for conduit 28. Flange 56 is moreover accepted within the recess 48 of fuel rail end 26 and bears against annular flange 52 of conduit end 28*a*. A suitable O-ring seal 58 seals the end 28*a* and fuel rail 16 against fuel leakage from the recess 48.

The bearing relationship between retainer flange 56 and annular flange 52 of conduit end 28*a* axially restrains conduit end 28*a* against separation from the recess 48 of fuel rail end 26. In addition, the arcuate saddle support provided by means of retainer flange 56 allows relative rotational movements between the conduit 28 and the fuel rail 16. During production therefore, any angular mismatch which may be present between the injectors 22 and the engine 10 may be corrected by simply pivoting the fuel rail 16 and/or conduit 28 until the desired angular orientation is achieved.

The description above with respect to the coupling means 46 associated with end 26 of fuel rail 16 is equally applicable to the coupling means 46 associated with the other end 34 of fuel rail 34, in addition to coupling means 46 associated with ends 24 and 32 of fuel rail 14. Suffice it to say that wherever a rigid conduit is to be coupled to either of the fuel rails 14 or 16, it is preferred according to the present invention that the coupling means 46 be of the type described above with reference to FIG. 4 (i.e., so as to permit the beneficial relative rotational movements between the rigid conduits and the fuel rail).

During engine production, the injectors 20 and 22 will be coupled to the fuel rails 14 and 16, respectively. That is, the injectors 20 and 22 will be received in a respective one of ports 14*a*–14*c* and 16*a*–16*c* and will be maintained therewithin via clips 60. In this regard, it will be observed that the fuel rails 14 and 16 each define a lateral, axially extending ledge surface 64, 66, respectively. One end of the clip 60 is thus supported by a respective ledge surface 64, 66, while the other end thereof engages a respective one of the injectors 20, 22. The clips 60 thus ensure that the injectors 20 and 22 will be retained in their respective ports 14*a*–14*c* and 16*a*–16*c* during engine production.

Figure 5:
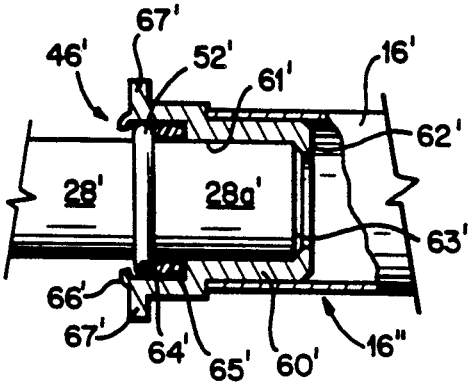
FIG. 5 is an enlarged detail view of another coupling means which may be employed according to this invention to couple conduits to a fuel rail.

FIG. 5 shows another specific embodiment of the coupling means 46' which may be employed according to this invention so as to couple a rigid conduit 28' to a tubular fuel rail 16' to allow for relative rotational movements about the longitudinal axis of the latter. As was similar to the conduit 28 described above with particular reference to FIG. 4, the conduit 28' in the embodiment of FIG. 5 includes a terminal end 28*a'* and an integral annular flange 52'.

A connector fitting 60' is rigidly coaxially attached to the terminal end 16'' of fuel rail 16' and defines an inner cylindrical surface 61 sized and configured so as to closely match the external surface of terminal end 28*a*'. The fitting 60' also includes an annular beveled stop 62' which provides a seat for the annular beveled edge 63' of terminal end 28*a*'. Thus, stop 62' limits the axial extent to which end 28*a*' may be inserted into the fitting 60', while also providing a bearing surface for edge 63' during rotational movements of conduit 28' and/or fuel rail 16'.

An annular recessed surface 64' is defined at end of fitting 60' opposite to its stop 62' and is adapted to receiving a suitable O-ring seal 65' therein. The annular flange 52' of conduit 28' is maintained in sealing contact with the O-ring seal 65' by means of an inwardly turned (i.e., towards the longitudinal axis of conduit 16') integral retaining flange 66'. Slight axial play is allowed for flange 52' within the recessed surface 64' of fitting 60' so that the former is not "pinched" against the O-ring seal 65' to an extent which would preclude relative rotational movements between the conduit 28' and the fuel rail 16'. Of course, the axial play should not be of such a magnitude whereby the sealing contact between the flange 52' and the O-ring seal 65' could be lost. The retaining flange 66' is preferably annular (i.e., without discontinuities) but could be formed of a number of segments without detrimentally affecting its intended function.

The coupling assembly 46' shown in FIG. 5 is most conveniently fabricated by sliding the terminal end 28*a*' into the fitting 60' (the latter having already been fixed within the end 16'' of fuel rail 16') with the O-ring seal 65' being positioned about the terminal end 28*a*' near the annular flange 52'. At this point, the retaining flange is not inwardly turned as shown in FIG. 5, but instead extends outwardly from the fitting 60' substantially parallel to the axis of fuel rail 16'. Thereafter, the fitting 6O'/fuel rail 16'/conduit 28' subassembly may then be supported upon a work table via support flanges 67' formed on the fitting 6O' so that a forming tool may be brought into contact with the retaining flange 66' to cause it to turn inwardly to the extent shown in FIG. 5.

It will be observed in FIG. 1, that the supply and discharge nipples 30 and 42 are relatively physically close to one another so as to facilitate their connection to a vehicle's fuel system. Other embodiments of this invention which also achieve close physical association of supply and discharge conduits are shown in accompanying FIGS. 6–10. The fuel rail assemblies 70 and 120 shown in FIGS. 6–8 and FIGS. 9–10, respectively, are also particularly well suited for use with internal combustion engines having cylinders configured in an "in-line" manner.

Figure 8:
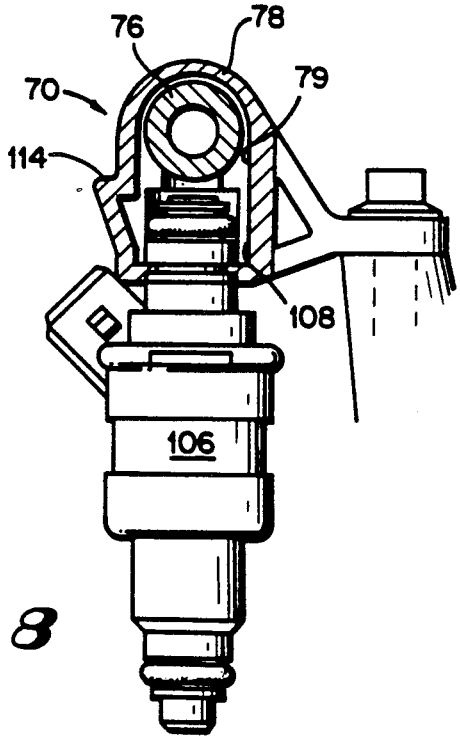
FIG. 8 is a cross-sectional end view taken along line 8—8 in FIG. 6 showing the relationship between the fuel rail and a representative fuel injector.
Figure 6:
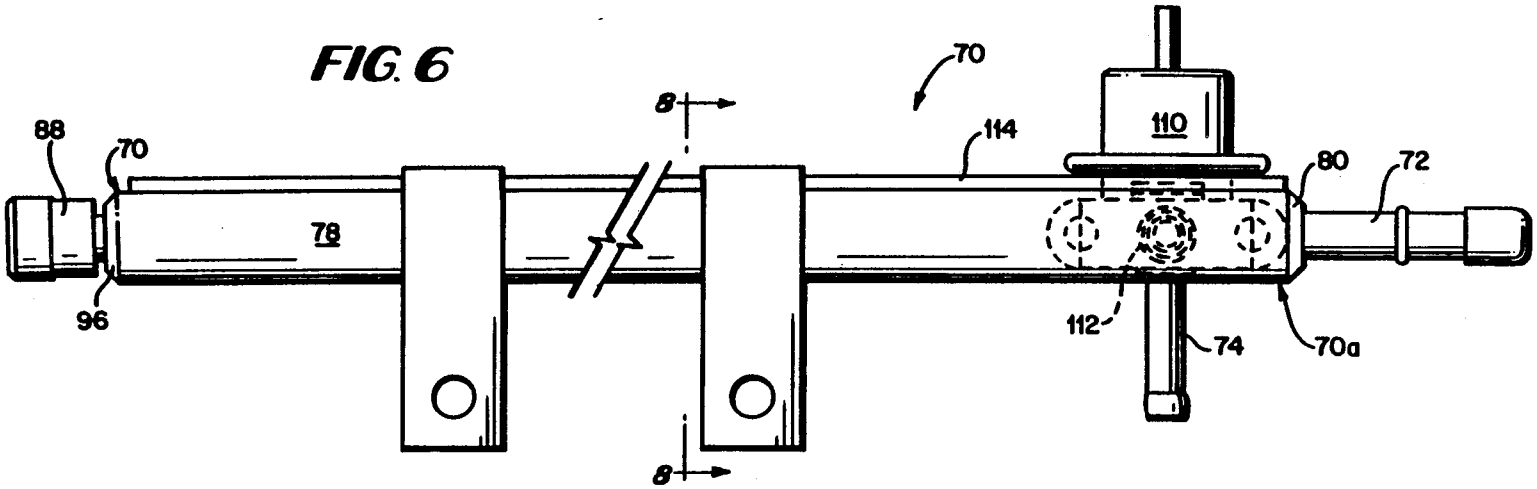
FIG. 6 is a top plan view of another specific fuel rail assembly according to the present invention.
Figure 7:
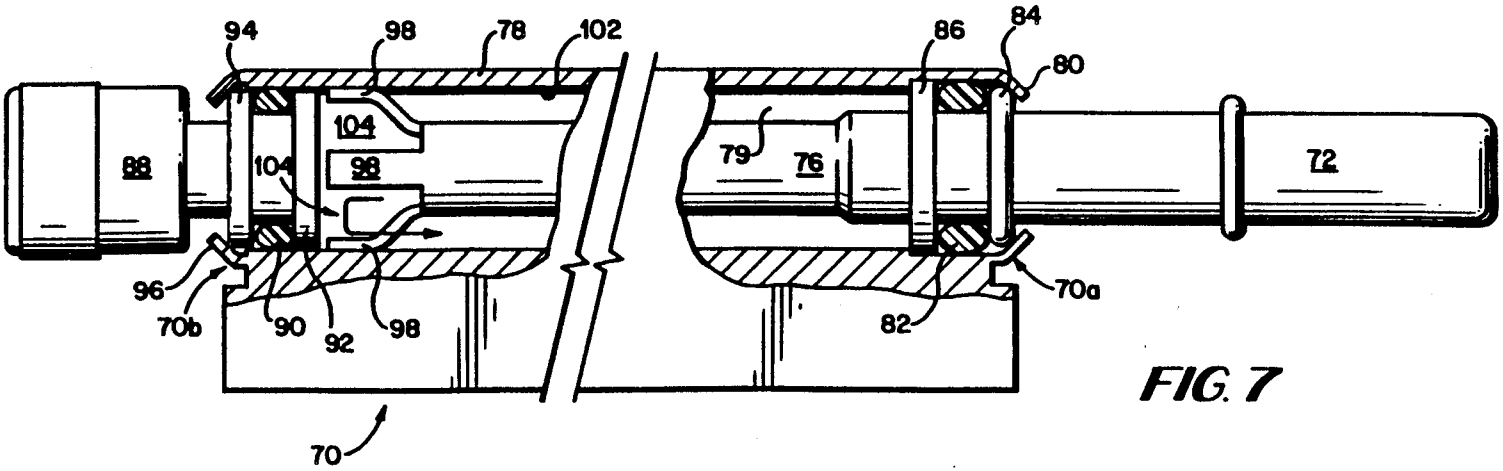
FIG. 7 is a cross-sectional elevational view of the terminal ends of the fuel rail shown in FIG. 6.

As is seen in FIGS. 6–8, the fuel rail assembly 70 includes an inlet nipple 72 and an outlet nipple 74 for respective fluid connection to the supply and return sides of a vehicle's fuel system. The supply nipple 74 is preferably an integral extension of an inner conduit 76 as can be seen more clearly in accompanying FIG. 7. The supply nipple 72 (and hence the inner conduit 76) is preferably concentrically disposed within an outer conduit 78 so as to establish an annular passageway 79 therebetween. The inner conduit 76 is retained within the outer conduit 78 of the fuel rail assembly 70 at its supply end 7O*a* by means of an inwardly turned flange 80. Fluid leakage is prevented at end 7O*a* by means of an O-ring seal 82 positioned between an axially separated pair of annular flanges 84, 86 associated with the inner conduit 76.

The inner conduit 76 extends (preferably coaxially) within the outer conduit 78 to closely adjacent the terminal end 7O*b* of the fuel rail assembly 70. The terminal end 7O*b* is closed by means of a diagnostic fitting 88 (which serves to allow measurement of the pressure which may exist within the fuel circuit established by the fuel rail 70) and is sealed against fuel leakage thereat by means of an O-ring seal 90 positioned between a pair of axially spaced apart annular flanges 92, 94. The fitting 88 is retained within the terminal end 70*b* by means of an inwardly turned flange 96 in a manner similar to flange 80 employed at end 70*a* to retain the supply nipple 72.

The downstream end of inner conduit 76 terminates in a number (preferably pairs of) radially flared segments 98. Each of the segments 98 is formed by removing adjacent material from the downstream end of inner conduit 76, and then flaring the remaining material radially outward. A portion of each segment 98 will thus contact the inner surface 100 of the outer conduit 78 so as to positionally maintain the inner conduit 78 in its substantially coaxial relationship within outer conduit 78. Adjacent ones of the segments 98 will also define therebetween respective open regions 104 to thereby establish fluid communication between the inner conduit 76 and the annular passageway 79.

Fuel which is supplied to the inlet nipple 72 flows through the inner conduit 76 towards its downstream end where it exits via the open regions 104 and then flows through the annular passageway 79. As is perhaps more clearly seen in FIG. 8, the annular passageway 79 is fluid-connected to the injectors 106 via respective ports 108 (only one such port 108 and its associated injector 106 are shown in FIG. 7 as being representative of a number of the same). Fuel not supplied to the injectors 106 then flows to closely adjacent the supply end 70*a* where it is directed to a fuel regulator 110 via an outlet opening 112 (see FIG. 6). After flowing through the regulator 110, the fuel is then discharged to the return side of the vehicle's fuel system via the discharge nipple 74.

It will be observed in FIGS. 6 and 8 that the fuel rail 70 may also define a longitudinally extending, lateral ledge surface 114 so as to support one end of a clip member (not shown in FIGS. 6–8) for maintaining the injectors 106 within their respective ports 108. Thus, the fuel rail assembly 70 shown in FIGS. 6–8 may be provided with a lateral ledge surface to accomplish a similar purpose as the ledge surfaces described above with reference to the embodiment of this invention shown in FIGS. 1–4. The nipple 72/inner conduit 76 may also be mounted within the outer conduit 78 via flange 80 so that the former structures are capable of rotating relative to the latter structure and thereby allow correction of any angular mismatch between the injectors 106 and the engine during production.

Figure 9:
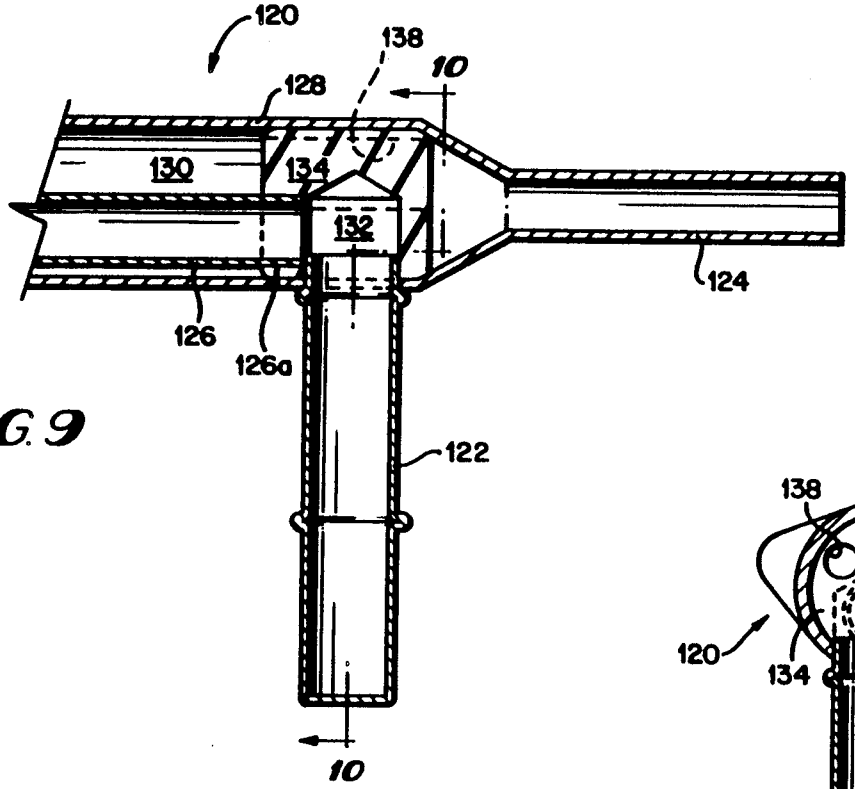
FIG. 9 is an enlarged partial cross-sectional view of another specific fuel rail assembly according to this invention.
Figure 10:
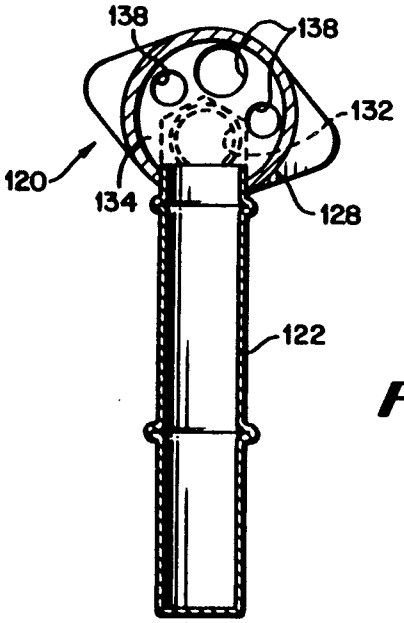
FIG. 10 is an end view of the fuel rail assembly shown in FIG. 9 as taken along line 10—10 therein.

Accompanying FIGS. 9 and 10 show another embodiment of a fuel rail assembly 120 according to this invention which provides for close physical relationship between a fuel supply nipple 122 and a fuel discharge nipple 124. The fuel rail assembly 120 includes an inner conduit 126 which is positioned within an outer conduit 128 so as to define therebetween an eccentric annulus 130. The inlet end 126*a* of conduit 126 is fitted into a blind hole 132 formed in a baffle plug 134 located within the outer conduit 128 near the discharge nipple 124. The supply nipple 122 communicates with the blind hole 132 by entering the same at substantially a right angle relative to the elongate axis of the inner conduit 126. In such a manner, the supply nipple is fluid-connected to the inner conduit 126.

The baffle plug 134 includes one or more through apertures 138 which fluid-connect the eccentric annulus 130 and the discharge nipple 124. The downstream end of the inner conduit 126 (not shown in FIG. 9) is preferably comprised of at least one radially outwardly flared segment so as to positionally maintain the inner conduit 126 within the outer conduit 128 and to establish fluid connection at the downstream end of conduit 126 with the eccentric annulus 130 (i.e., in a manner similar to the functions provided by means of the segments 89 shown in FIG. 7).

Therefore, fuel entering the supply nipple 122 is directed at substantially a right angle via blind hole 132 into the inlet end 126*a* of inner conduit 126 and then flows the length of inner conduit 126 towards its downstream end. The fuel then enters the eccentric annulus 130 at the downstream end of inner conduit 126 and flows towards the baffle plug 134 (i.e., in a direction countercurrent to the fuel flow within the inner conduit 126). The fuel then flows through the apertures 138 and into the supply nipple 124 where it may be directed to a downstream fuel pressure regulator (not shown).

The reader will now undoubtedly realize the advantages which may be achieved by means of the fuel rail assemblies according to this invention. Thus, while the present invention has been described in connection with what is presently considered to be the most practical and preferred embodiments, it is to be understood that the invention is not to be limited to the disclosed embodiments. Instead, the invention is intended to cover various modifications and equivalent arrangements included within the spirit and scope of the appended claims.

What is claimed is:

1. A fuel rail assembly for a V-configured internal combustion engine comprising:

a pair of elongate rigid tubular fuel rails each having a longitudinal axis such that said tubular fuel rails are disposed substantially parallel to one another, and such that in use each said tubular fuel rail is oriented substantially parallel to a respective bank of combustion chambers associated with the engine wherein respective ends of said fuel rails are laterally adjacent one another, and wherein each said fuel rail provides an available standby source of fuel for said respective bank of combustion chambers;

each fuel rail comprising a number of injector sockets separated from one another along the fuel rail's longitudinal axis for receiving fuel injectors such that each fuel injector will be disposed with its own longitudinal axis transverse to its fuel rail, said injector sockets thereby supplying fuel to the injectors from the standby source of fuel provided by the fuel rails so that fuel will be emitted from each injector transversely of its fuel rail; and rigid conduit means arranged transverse to said fuel rails, including a rigid conduit for fluid-connecting one fuel rail to the other fuel rail, said rigid conduit means comprising terminal end portions that are fitted in a sealed manner to opposite longitudinal ends of one of said fuel rails such that said one fuel rail is circumferentially positionable with respect to said terminal end portions about an imaginary axis extending between said terminal end portions to thereby allow the fuel rail assembly to be adjusted at the time of its assembly to an engine to secure a desired relative angular relationship of the axes of the sockets of said one fuel rail to the axes of the sockets of the other fuel rail and hence facilitate the process of assembling the fuel rail assembly to an engine in the event of small relative misalignment between the axes of the fuel rail sockets of both fuel rails and the axes of holes in the engine with which the sockets are intended to coalign.

2. A fuel rail assembly as claimed in claim 1 wherein said rigid conduit means includes a second rigid conduit, said first-mentioned rigid conduit comprising one of said terminal end portions and said second rigid conduit comprising another of said terminal end portions.

3. A fuel rail assembly as claimed in claim 2 wherein said first-mentioned rigid conduit comprises a terminal end section at an end thereof opposite said one terminal end portion, said one terminal end portion and said terminal end section being substantially mutually parallel.

4. A fuel rail assembly as claimed in claim 3 wherein said terminal end section and said one terminal end portion connect to their respective rigid tubular fuel rails at the same longitudinal end of each fuel rail.

5. A fuel rail assembly as claimed in claim 2 wherein said second rigid conduit connects to a fluid pressure regulator mounted on said other fuel rail.

6. A fuel rail assembly as claimed in claim 1 wherein said rigid conduit means comprises a rigid conduit comprising at one end thereof, one of said terminal end portions, and at another end thereof, a terminal end section, said terminal end section being substantially parallel to said one terminal end portion.

7. A fuel rail assembly as claimed in claim 6 wherein said terminal end section and said one terminal end portion connect to their respective rigid tubular fuel rails at the same longitudinal end of each fuel rail.

* * * * *